United States Patent [19]

Greener

[11] Patent Number: 4,487,035

[45] Date of Patent: Dec. 11, 1984

[54] COLD STORAGE CELL FOR REFRIGERATION SYSTEM

[76] Inventor: Richard C. Greener, P.O. Box 657, Lancaster, Pa. 17604

[21] Appl. No.: 487,816

[22] Filed: Apr. 22, 1983

[51] Int. Cl.[3] ..... F25D 17/04

[52] U.S. Cl. ..... 62/406; 62/529

[58] Field of Search ..... 62/430, 529, 530, 406

[56] References Cited

U.S. PATENT DOCUMENTS

| | | | |
|---|---|---|---|
| 2,145,308 | 1/1939 | Jordan et al. | 62/430 |
| 2,191,519 | 2/1940 | Cornell, Jr. | 62/406 |
| 2,211,636 | 8/1940 | Bates | 62/530 |
| 2,303,369 | 12/1942 | Kleist | 62/530 |

*Primary Examiner*—Ronald C. Capossela
*Attorney, Agent, or Firm*—Harvey B. Jacobson

[57] ABSTRACT

A cold storage cell in the form of a hollow plate or shell constructed of material having high heat conductivity and filled with a eutectic solution having a freezing point substantially below the freezing point of water in order to enable the latent heat of fusion of the freezable solution to be utilized at a lower temperature for cooling and freezing of various food items or non-food items. The cold storage cell is closed and filled with a solution of ethylene glycol and water propylene glycol and water or a brine solution in which the ratio of the glycol to water may be varied depending upon the freezing temperature desired. The cold storage cells are used in various types of refrigeration systems such as the type employing an air blast to cool the cold storage cells from ambient temperature to a temperature where the freezable solution is frozen which cooling process can take a relatively long period of time depending upon the air temperature, the amount of freezable liquid solution in the cells, the refrigeration system capacity, the number of the cells and the like so that all of the cells will be cooled sufficiently to remove the latent heat of fusion of the freezable solution after which the refrigeration system is ready for loading with items to be cooled. As the items or products are loaded into the refrigeration machine, the warmer items or products will be cooled by the cells as the refrigeration stored in the cells is released with the refrigeration system continuing to operate at its capacity which may be at a capacity less than the refrigeration released by the cells or at a capacity sufficient to replace the refrigeration released by the cells to the items or products.

4 Claims, 3 Drawing Figures

COLD STORAGE CELL FOR REFRIGERATION SYSTEM

BACKGROUND OF THE INVENTION

1. Field of the Invention

The present invention generally relates to refrigeration systems and more specifically a cold storage cell utilized in an air blast refrigeration apparatus or machine which replaces currently used supporting trays for a pluraility of items or products which are placed on the trays for heat removal and freezing by circulation of cooled air with the cold storage cell or cells being in the form of hollow shells of heat conductive material filled with a freezable solution of ethylene glycol and water of predetermined ratio having a freezing temperature less than the freezing temperature of water so that the latent heat of fusion of the freezable solution may be utilized at a lower temperature to more effectively and quickly freeze the items or products placed in supporting contact with the upper surface of the cold storage cell or cells with the air blast refrigeration system continuing to operate to partially replace or completely replace the refrigeration released by the cold storage cell or cells to the items or products to enable the refrigeration system to operate continuously at a predetermined capacity.

2. Description of the Prior Art

Cold hold plates utilizing eutectic solutions have been in use for many years with such devices normally employing a coil in the form of an evaporator in a refrigeration system incorporated into the plate for the purpose of freezing a eutectic solution in order to prolong the availability of refrigeration in order to maintain products in a refrigerated space at a desired temperature. Such devices have been used in association with vehicle truck bodies such as delivery trucks used in delivering various refrigerated products, such as home delivery of dairy products and the like. The following U.S. patents relate to this field of endeavor: U.S. Pat. Nos. 2,145,308, Jan. 31, 1939; 2,428,313, Sept. 30, 1947; 2,664,716, Jan. 5, 1954; 2,875,595, Mar. 3, 1959; 3,845,638, Nov. 5, 1974; 4,339,928, July 20, 1982.

SUMMARY OF THE INVENTION

An object of the present invention is to provide a cold storage cell utilized with a refrigeration system of the type including an air blast circulation system associated with an insulated space and a plurality of trays onto which items or products are conveyed and stored while air circulates over and around such products in order to reduce their temperature with such products including food or non-food items in which it is desired to rapidly freeze those products so that they may be removed from the refrigerated space and additional products placed therein with the cold storage cell of the present invention replacing the supporting trays or shelves in such a refrigeration system.

Another object of the invention is to provide a cold storage cell in the form of a hollow shell filled with a liquid freezable solution including a mixture of water and ethylene glycol to reduce the freezing temperature of the solution to a temperature below the freezing temperature of water to enable the latent heat of fusion of the freezable solution to be released to the items or products stored on the shell at a temperature lower than the freezing temperature of water with the quantity of freezable solution determining the BTUs that can be removed from the item or products stored on the shell.

A further object of the invention is to provide a cold storage cell in accordance with the preceding objects in which the shell is constructed of aluminum or other material having high heat conductivity with the inner surface of the shell including heat exchange fins integral therewith to assure good heat exchange between the solution in the cell and the surface of the shell on which the items or products are supported, thereby providing good heat conducting characteristics between the items or products and the freezable solution within the shell.

Still another object of the present invention is to provide a cold storage cell for refrigeration systems which is simple in construction, easily installed in the refrigerated space for supporting items or products to be utilized and capable of replacing existing supporting trays or shells utilized in air blast type of refrigeration systems.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
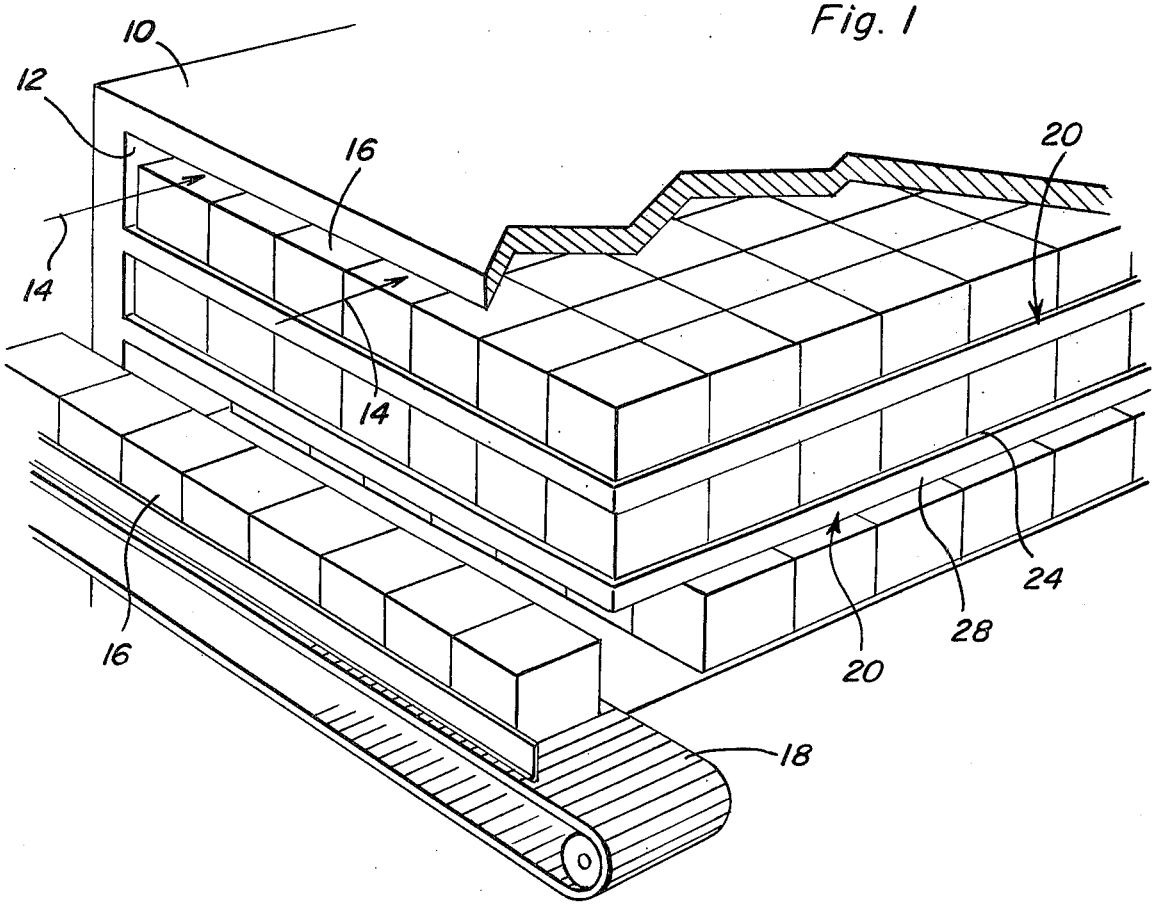
FIG. 1 is a schematic perspective view of an air blast refrigeration system in which the cold storage cell or cells of the present invention is utilized.
Figure 2:
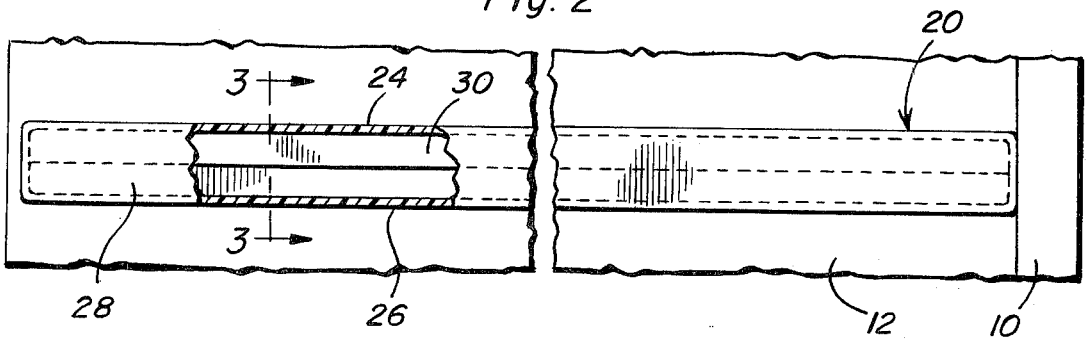
FIG. 2 is an elevational view of one of the cold storage cells with portions broken away illustrating the interal structure thereof.
Figure 3:
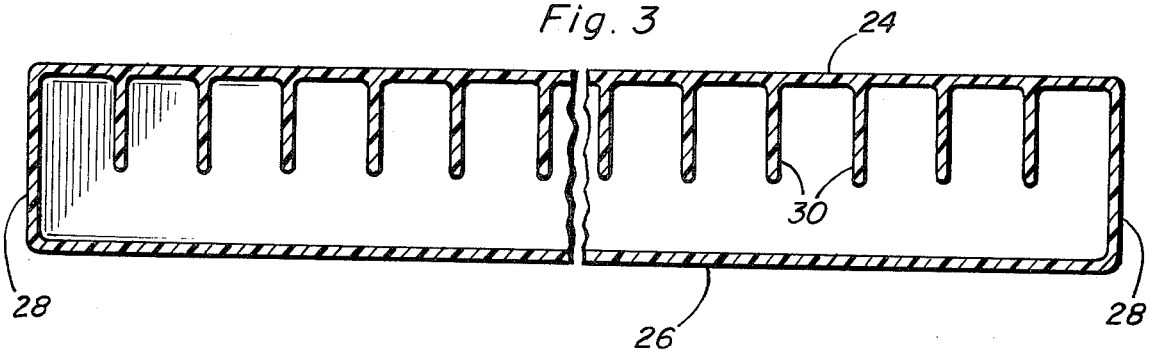
FIG. 3 is a transverse, sectional view taken substantially upon a plane passing along section line 3—3 on FIG. 2 illustrating further structural details of the cold storage cell.

Referring now specifically to the drawings, FIG. 1 illustrates an air blast refrigeration system including a housing or cabinet 10 having an enclosed refrigeration space 12 through which refrigerated or cooled air is circulated as indicated by the arrow 14 in FIG. 1. Conventionally, items or products 16 to be frozen are conveyed to the housing 10 on a conveyor 18 and the items or products 16 are slid onto a supporting tray and stored within the refrigerated space 12 for a sufficient period of time to freeze the items or products 16 after which they are removed from the refrigerated space 12 and stored or delivered to a point of sale to customers or users. The cold storage cell of the present invention is generally designated by numeral 20 and forms a support for a plurality of the items or products 16 as illustrated in FIG. 1 with the cold storage cells 20 actually replacing conventional trays or shelves that support the items or products. As illustrated, the housing 10 may have a plurality of cold storage cells 20 incorporated therein depending upon the capacity desired. Conventionally, air blast refrigeration systems rely upon circulation of cold air to remove heat from the items or products so that the products are frozen with the heat removed from the products being transferred first to a moving system of air and then to a refrigerant in an enclosed circulating system. While such systems operate effectively, the refrigerant load requirements varies as the temperature of the items or products approach their freezing temperature. This sometimes is alleviated by moving the products progressively through the refrigerated space in an effort to maintain the heat load more or less constant.

The cold storage cell 20 of the present invention enables storage of refrigeration therein so that the refrigeration can be released upon demand. Specifically, the cold storage cell 20 includes a hollow shell 22 including an upper plate 24 and a lower plate 26 interconnected by peripheral walls 28. The shell 22 may be longitudinally extruded to any desired length with the ends being capped in order to close the space within the interior of the shell 22. The upper plate 24 is provided with a plurality of depending fins 30 in the form of heat exchange fins which extend for a substantial vertical distance toward the bottom plate 26 with the fins 30 being unitary with the upper plate 24 in order to provide good heat conduction between a freezable solution which fills the interior of the shell 22 and the upper plate 24. As illustrated, the shell 22 is installed horizontally into housing 10 and supported therein in any suitable manner to provide a supporting surface for a plurality of items or products 16 so that the cold upper plate 24 will quickly and rapidly remove heat from the products 16 resting thereon. As illustrated, there is no refrigerant connection to the cells 20 in that each of the cells 20 is isolated from each other and from the refrigerant system with the circulating cold air blast being the sole means to cool and freeze the liquid freezable solution within the cells 20.

Depending upon the temperature required for the particular application, the liquid freezable eutectic solution is a mixture of water and ethylene glycol or water and propylene glycol, which is preferred in association with food products, at a predetermined ratio. The eutectic solution may also be in the form of a brine solution having a freezing temperature less than 32° F. For example, if the freezing temperature of the eutectic solution is desired to be minus 15° F., the solution will be approximately 40% ethylene glycol and 60% water so that at minus 15° F., the water in the solution will change to ice when 144 BTUs per pound of water is removed which represents the latent heat of fusion. Conversely, the frozen eutectic solution in the cell will remove 144 BTUs per pound of water from the products 16 at minus 15° F. when the solution in the cell is removing heat from the products. Accordingly, by determining the heat load normally existent in a predetermined quantity of products, the capacity of the refrigeration storage cell or cells can be easily computed. The existing air blast refrigeration system is used to cool the cells from ambient temperature to a temperature where the water portion of the solution will freeze and to any desired lower temperature. Air is the medium cooling the cells and this cooling process can take any desired time period depending upon the installational requirements and depending upon the cooling air temperature, the quantity of liquid solution in the cells, the refrigeration system capacity, the number of cells and other physical characteristics. After the cells have been cooled sufficiently to remove the latent heat of fusion of the water in the solution and to a desired lower temperature if necessary, the machine will then be ready for loading with the items to be cooled. As the product is loaded, the warmer product will be cooled by the cells as the stored refrigeration is released and the refrigeration system will continue to operate at capacity with the capacity being either sufficient to completely replace the refrigeration released by the cells to the products or at a capacity less than that released by the cells. When the refrigeration is released from the cells at a faster rate than replacement, this normally occurs for a short duration with the refrigeration being replaced at a slower rate over a longer duration thereby serving to improve product quality by cooling faster while keeping heat loads on the refrigeration system substantially level to enable a refrigeration system having less capacity to cool and freeze larger quantities of products inasmuch as cold is stored in the cells during those periods when the heat released to the products is less than the capacity of the refrigeration system and cold is released to the products when the heat load of the products is greater than the capacity of the refrigeration system.

While the invention has been illustrated with an air blast refrigeration system, it can be used with various types of refrigeration systems which are commercially available at the present time depending upon the requirements for each installation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a refrigeration system of the type including an air blast cool air circulating system for removing heat from products, that improvement comprising a refrigeration storage cell on which the products are supported during air circulation thereover, said cell including a hollow shell filled with a eutectic solution capable of being frozen at a temperature lower than the freezing temperature of water by the cool air circulating in the refrigeration system in air to surface heat exchange relation thereby enabling the latent heat of fusion of the solution to be used at a temperature lower than the freezing temperature of water to remove heat from the products stored on the cell in a a rapid and efficient manner by conducting heat from the products into the solution while cool air circulates over the products, said cell including a hollow shell having flat, parallel top and bottom plates of heat conductive material, a peripheral wall connecting the periphery of the plates to form said shell, said eutectic solution including glycol and water, said top plate of the shell including depending, parallel, mutually spaced fins integral therewith for effective heat exchange between the eutectic solution and the shell.

2. A cold storage cell for use in a cold air circulating refrigeration system comprising a hollow shell having substantially parallel top and bottom plates spaced from each other to define a space filled with a liquid freezable solution, said plates being flat and continuous to form smooth and uninterrupted surfaces, parallel, spaced, inwardly extending heat exchange fins on the upper plate to provide effective heat exchange between the solution and upper plate on which products to be cooled are placed, said solution including a mixture of water and an additive to form an eutectic solution to reduce the freezing temperature of the solution to a temperature below the freezing temperature of water to enable latent heat of fusion of the freezable solution to be utilized in removing heat from the products to be cooled at a temperature below the freezing temperature of water.

3. The cell as defined in claim 2 wherein said solution includes glycol and water with the freezing temperature being less than 32° F. to enable the latent heat of fusion of the solution to be removed from the product at a temperature below 32° F.

4. An air blast refrigeration system comprising a cabinet having an enclosed refrigeration space through which refrigerated air is circulated, products movable into the enclosed space and stored therein for a sufficient time to be frozen, means supporting the products in the enclosed space, said means supporting the products comprising a cold storage cell comprising a substantially flat, horizontally disposed top plate, a substantially flat horizontally disposed bottom plate, a peripheral wall connecting the periphery of the top and bottom plates and positioning them in spaced relation and defining a generally rectangular shell containing a quantity of eutectic solution, said top plate including a plurality of depending, substantially parallel, mutually spaced fins integral therewith to enhance heat exchange between the top plate and eutectic solution, said cold cell being exposed to the refrigerated air blast throughout its surface area when products are not supported on the top plate to enable the eutectic solution to be frozen with the latent heat of fusion of the frozen eutectic solution interiorly of the cold cell rapidly removing heat from the unfrozen products when they are placed on the top surface of the cold cell and moved in a progressive manner across the top surface of the cold cell with the air blast refrigeration system simultaneously removing heat from the products to be frozen thereby reducing the time required to freeze the products and enabling the air blast refrigeration system to operate at peak capacity for freezing the eutectic solution during periods in which the air blast is not utilizing all of its cooling capacity for removing heat from the products to be frozen.

* * * * *